US009735463B2

(12) United States Patent
Lee

(10) Patent No.: US 9,735,463 B2
(45) Date of Patent: Aug. 15, 2017

(54) ANTENNA ASSEMBLY AND WIRELESS COMMUNICATION DEVICE USING THE SAME

(71) Applicant: Chiun Mai Communication Systems, Inc., New Taipei (TW)

(72) Inventor: Chih-Ho Lee, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 16 days.

(21) Appl. No.: 14/816,566

(22) Filed: Aug. 3, 2015

(65) Prior Publication Data

US 2017/0040667 A1 Feb. 9, 2017

(51) Int. Cl.
*H01Q 1/24* (2006.01)

(52) U.S. Cl.
CPC ..... *H01Q 1/243* (2013.01)

(58) Field of Classification Search
CPC ..... H01Q 1/243
USPC ..... 343/702
See application file for complete search history.

(56) References Cited

U.S. PATENT DOCUMENTS 6,853,341 B1 2/2005 Hellgren et al.
7,321,334 B2 * 1/2008 Yu ..... G06F 1/1616 343/702
8,344,957 B2 * 1/2013 Wakabayashi ..... H04W 88/06 343/702
2004/0257283 A1 12/2004 Asano et al.
2014/0266928 A1 9/2014 Gummalla

FOREIGN PATENT DOCUMENTS

TW 201220597 5/2012

* cited by examiner

*Primary Examiner* — Graham Smith
(74) *Attorney, Agent, or Firm* — Steven Reiss

(57) ABSTRACT

A wireless communication device includes a housing and an antenna assembly. The housing including a metallic frame having a first side plate and a second side plate connected to the first side plate, the first side plate defines a first opening, and the second side plate defines a second opening. The antenna assembly includes a first antenna and a second antenna. The first antenna is received in the first opening, secured on the first side plate and grounded by the first side plate. The second antenna is received in the second opening and is secured on the second side plate and grounded by the second side plate.

18 Claims, 9 Drawing Sheets

ANTENNA ASSEMBLY AND WIRELESS COMMUNICATION DEVICE USING THE SAME

FIELD

The subject matter herein generally relates to antenna assemblies, and particularly to a multiband antenna assembly, and a wireless communication device using the same.

BACKGROUND

Wireless communication devices such as smartphone and tablet PC are becoming increasingly popular, and some of them use one or several metallic members to form its partial housing for enhancing structural strength and improving aesthetics. However, the metallic member may deteriorate the performance of an antenna built inside the housing. Therefore, there is a need for designing an antenna assembly with good performance within a metallic housing.

BRIEF DESCRIPTION OF THE DRAWINGS

Implementations of the present technology will now be described, by way of example only, with reference to the attached figures.

DETAILED DESCRIPTION

Figure 1:
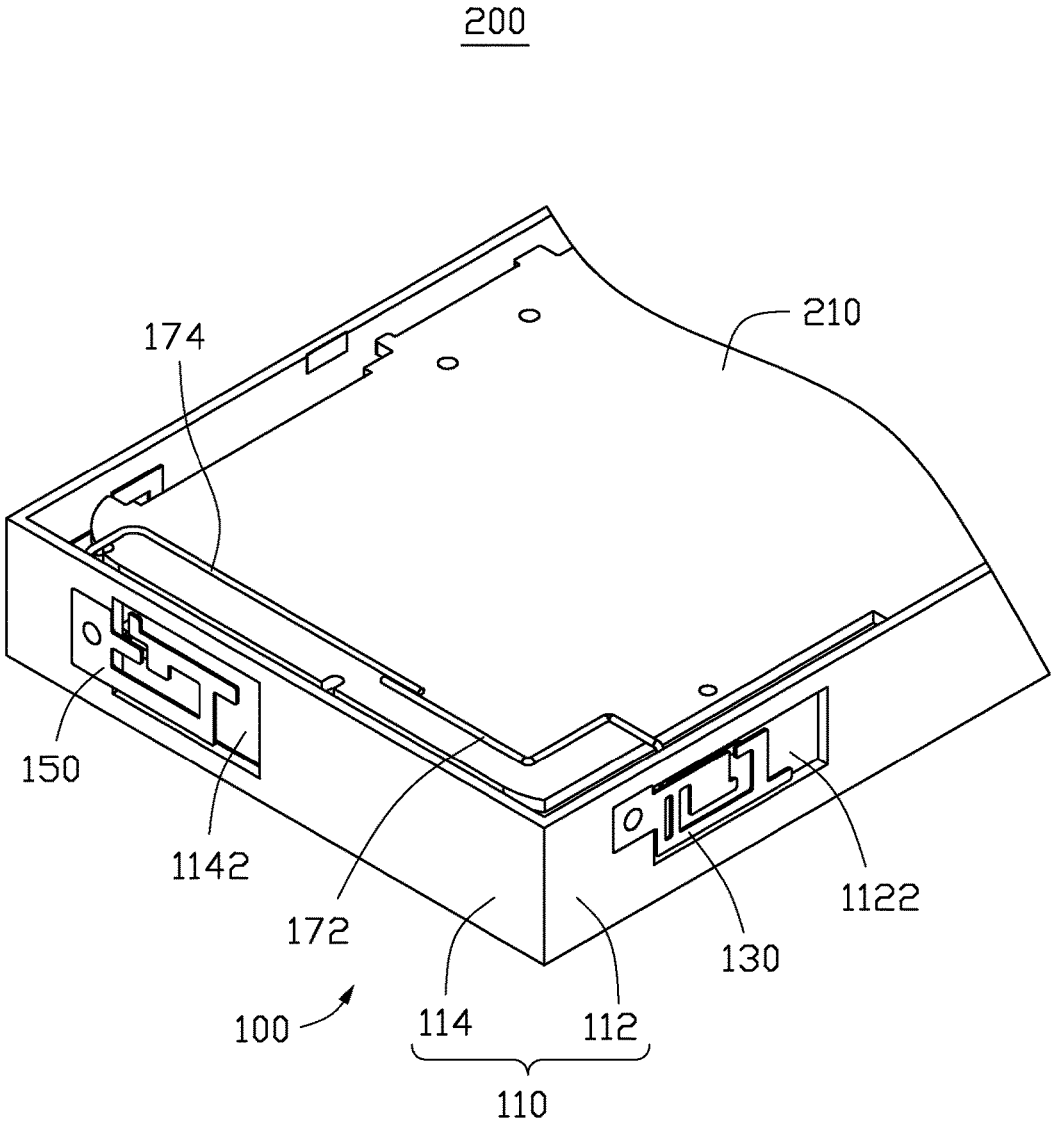
FIG. 1 is a partial diagrammatic view of a wireless communication device employing an antenna assembly, according to an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna assembly and a wireless communication device using same.

FIG. 1 illustrates an embodiment of a wireless communication device 200 employing an antenna assembly 100, according to a first exemplary embodiment. The wireless communication device 200 can be a smartphone, a tablet PC, or a smart camera with WiFi function, for example (details not shown).

The wireless communication device 200 further includes a baseboard 210. The baseboard 210 may be a printed circuit board (PCB) and has a feed pin (not shown) for providing current to the antenna assembly 100.

The antenna assembly 100 includes a metallic frame 110, a first antenna 130, and a second antenna 150.

The metallic frame 110 is a part of a housing of the wireless communication device 200. In at least one embodiment, the metallic frame 110 is a C-shaped metallic frame and surrounds three peripheral sides of the PCB 210. The metallic frame 110 includes a first side plate 112 and a second side plate 114 perpendicularly connected to the first side plate 112. In detail, the first side plate 112 defines a first opening 1122 for receiving the first antenna 130, and the second side plate 114 defines a second opening 1142 for receiving the second antenna 150.

In at least one embodiment, both the first opening 1122 and the second opening 1142 have substantially rectangular shapes.

Figure 2:
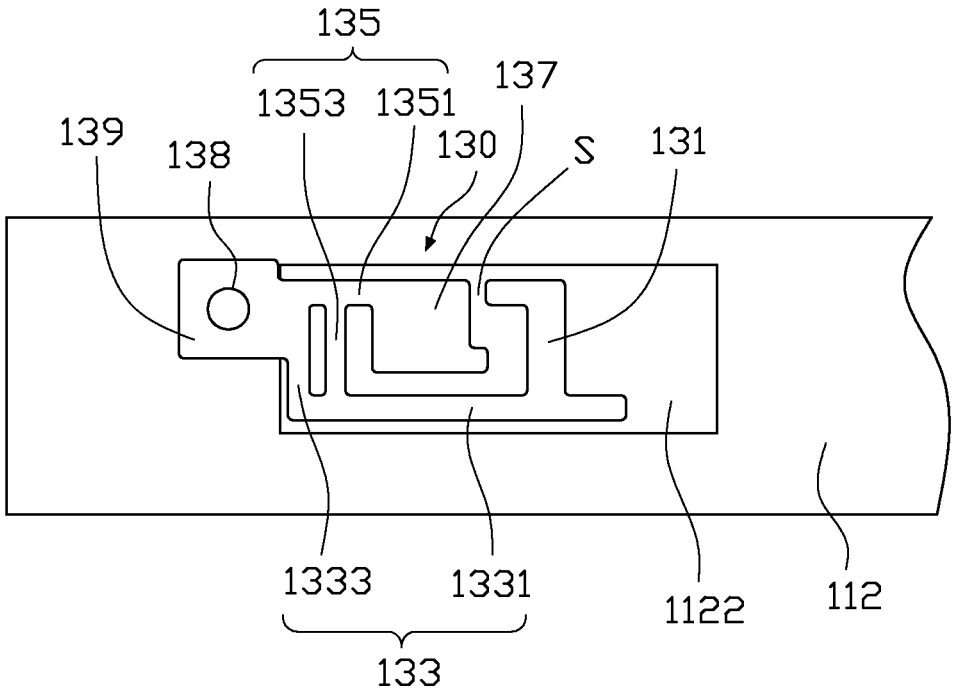
FIG. 2 is a diagrammatic view of a first antenna of the antenna assembly in FIG. 1.

Referring to FIG. 2, the first antenna 130 can be a dual-band loop antenna and includes a feed section 131, an extension section 133, a connection section 135, a coupling section 137, and a ground section 139 positioned coplanar with the feed section 131, the extension section 133, the connection section 135, and the coupling section 137.

Referring to FIGS. 1 and 2, the feed section 131 is an inverted L-shaped sheet and is electronically coupled to the feed pin of the PCB 210 via a first coaxial cable 172. The extension section 133 is an L-shaped sheet and includes a first extension sheet 1331 and a second extension sheet 1333. The first extension sheet 1331 is perpendicularly connected to the feed section 131. The second extension sheet 1333 is perpendicularly connected to the first extension sheet 1331 and is opposite to the feed section 131. The connection section 135 is a T-shaped sheet and includes a first connection sheet 1351 and a second connection sheet 1353 perpendicularly connected to the first connection sheet 1351. The first connection sheet 1351 is connected between the second extension sheet 1333 and the coupling section 137. The second connection sheet 1353 is parallel to the second extension sheet 1333 and is perpendicularly connected to the first extension sheet 1331. The coupling section 137 has a substantially rectangular shape and is spaced from the feed section 131. That is, a gap S is defined between the coupling section 137 and the feed section 131 to allow the current to be coupled from the feed section 131 to the coupling section 137. The ground section 139 is electrically connected to a side of the second extension sheet 1333 and is configured to be secured on the first side plate 112 for grounding the first antenna 130. In at least one embodiment, the ground section 139 is electrically connected to the first side plate 112 by a first metallic screw (not shown) through a hole 138 defined in the ground section 139. In other embodiments, the ground section 139 can be fixed on the first side plate 112 by other ways, such as welding. When the first antenna 130 is accommodated in the first opening 1122, the first antenna 130 can be shielded or covered by a plastic sheet (not shown) to protect the first antenna 130 from being exposed. Optionally, the plastic sheet can be integrated with the first side plate 112 by insert molding.

Figure 3:
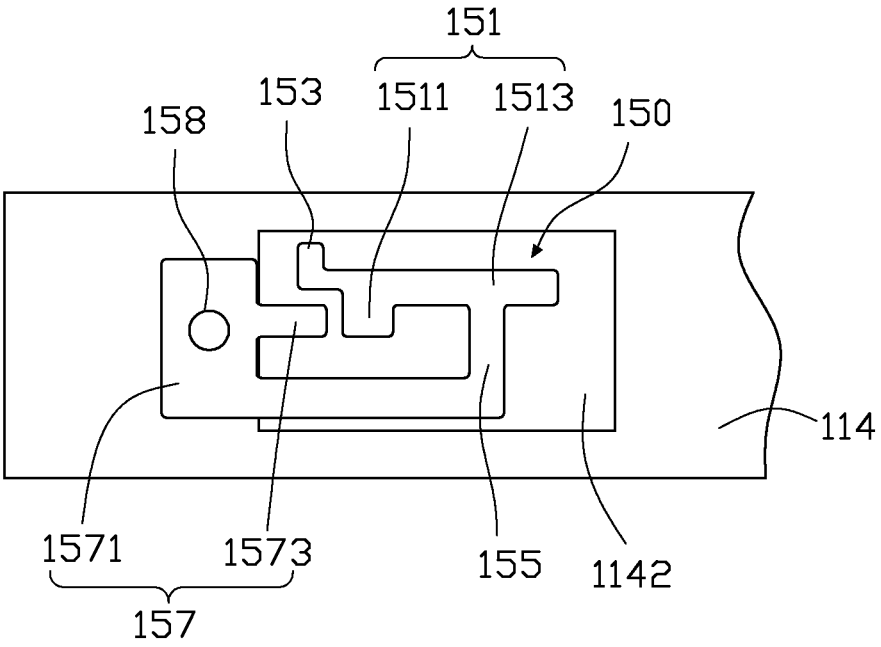
FIG. 3 is a diagrammatic view of a second antenna of the antenna assembly in FIG. 1.

Referring to FIG. 3, the second antenna 150 can be a dual-band loop antenna and includes a feed section 151, an extension section 153, a connection section 155, and a ground section 157 positioned coplanar with the feed section 151, the extension section 153, and the connection section 155.

Referring to FIGS. 1 and 3, the feed section 151 is an L-shaped sheet and is electronically coupled to the feed pin of the PCB 210 via a second coaxial cable 174. The feed section 151 includes a first feed branch 1511 and a second feed branch 1513 perpendicularly connected to the first feed branch 1511. The extension section 153 is an L-shaped sheet and is connected to a junction of the first feed branch 1511 and the second feed branch 1513. The connection section 155 is an L-shaped sheet, a first branch of the connection section 155 is perpendicularly connected to a middle portion of the second feed branch 1513, and a second branch of the connection section 155 extends parallel to the second feed branch 1513. The ground section 157 is a T-shaped sheet and includes a main branch 1571 and an extension branch 1573. The main branch 1571 is perpendicularly connected to the second branch of the connection section 155 and is configured to be secured on the second side plate 114 for grounding the second antenna 150. In at least one embodiment, the main branch 1571 is electrically connected to the second side plate 114 by a second metallic screw (not shown) through a hole 158 defined in the main branch 1571. In other embodiments, the main branch 1571 can be fixed on the second side plate 114 by other ways, such as welding. The extension branch 1573 is perpendicularly connected to the main branch 1571 and extends towards the first feed branch 1511. When the second antenna 150 is accommodated in the second opening 1142, the second antenna 150 can be shielded or covered by a plastic sheet (not shown) to protect the second antenna 150 from being exposed. Optionally, the plastic sheet can be integrated with the second side plate 114 by insert molding.

Figure 4:
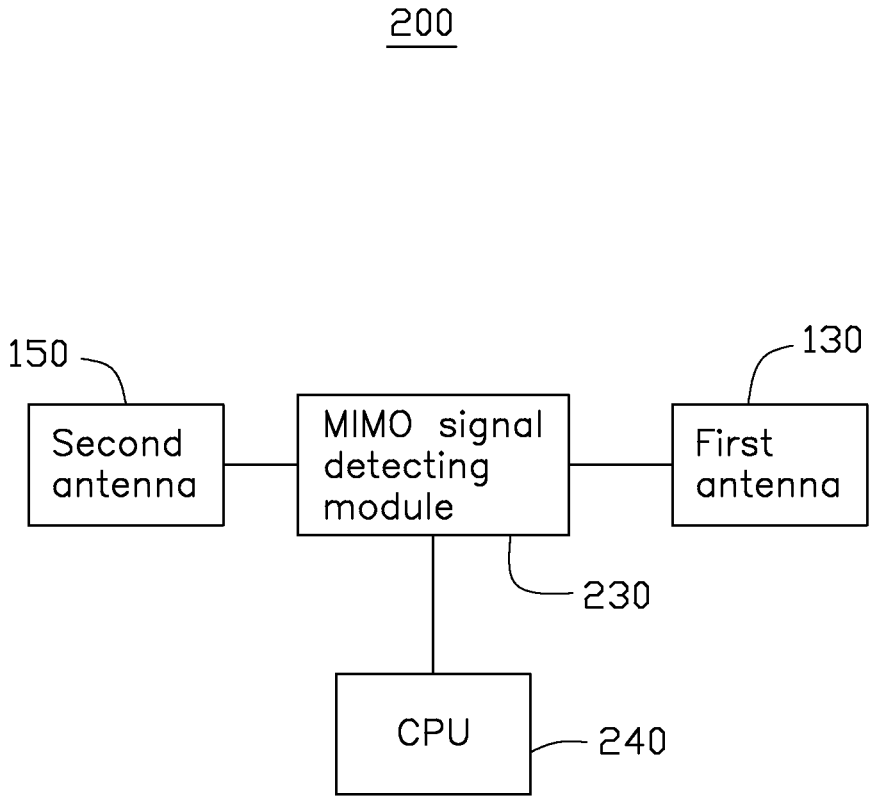
FIG. 4 is a block diagram of the wireless communication device in FIG. 1.

Further, referring to FIG. 4, the first antenna 130 and the second antenna 150 constitute a multiple input multiple output (MIMO) antenna system for receiving or transmitting wireless signals simultaneously. The wireless communication device 200 further includes a MIMO signal detecting module 230 and a central processing unit (CPU) 240 electronically coupled to the MIMO signal detecting module 230. The MIMO signal detecting module 230 is electronically coupled to the first antenna 130 and the second antenna 150 for detecting the signal intensity of a first wireless signal received or transmitted by the first antenna 130 and the signal intensity of a second wireless signal received or transmitted by the second antenna 150. In addition, the MIMO signal detecting module 230 is configured to compare the signal intensity of the first wireless signal with the signal intensity of the second wireless signal, so as to generate a comparison result. In detail, if the comparison result indicates that the detected signal intensity of the first wireless signal is greater than or equal to the detected signal intensity of the second wireless signal, the MIMO signal detecting module 230 outputs a first command (logic "1", for example) as the comparison result to the CPU 240. If the comparison result indicates that the detected signal intensity of the first wireless signal is less than the detected signal intensity of the second wireless signal, the MIMO signal detecting module 230 outputs a second command (logic "0", for example) as the comparison result to the CPU 240.

The CPU 240 is configured to determine one of the first antenna 130 and the second antenna 150 to serve as a primary antenna and another to serve as a secondary antenna according to the comparison result. If the CPU 240 receives the first command from the MIMO signal detecting module 230, the CPU 240 determines the first antenna 130 to serve as the primary antenna and the second antenna 150 to serve as the secondary antenna. At this time, the data amount of uplink/downlink communication between the first antenna 130 and a base station (not shown) may greater than the data amount of uplink/downlink communication between the second antenna 150 and the base station. If the CPU 240 receives the second command from the MIMO signal detecting module 230, the CPU 240 determines the first antenna 130 to serve as the secondary antenna and the second antenna 150 to serve as the primary antenna. At this time, the data amount of uplink/downlink communication between the second antenna 150 and the base station may greater than the data amount of uplink/downlink communication between the first antenna 130 and the base station.

Figure 5:
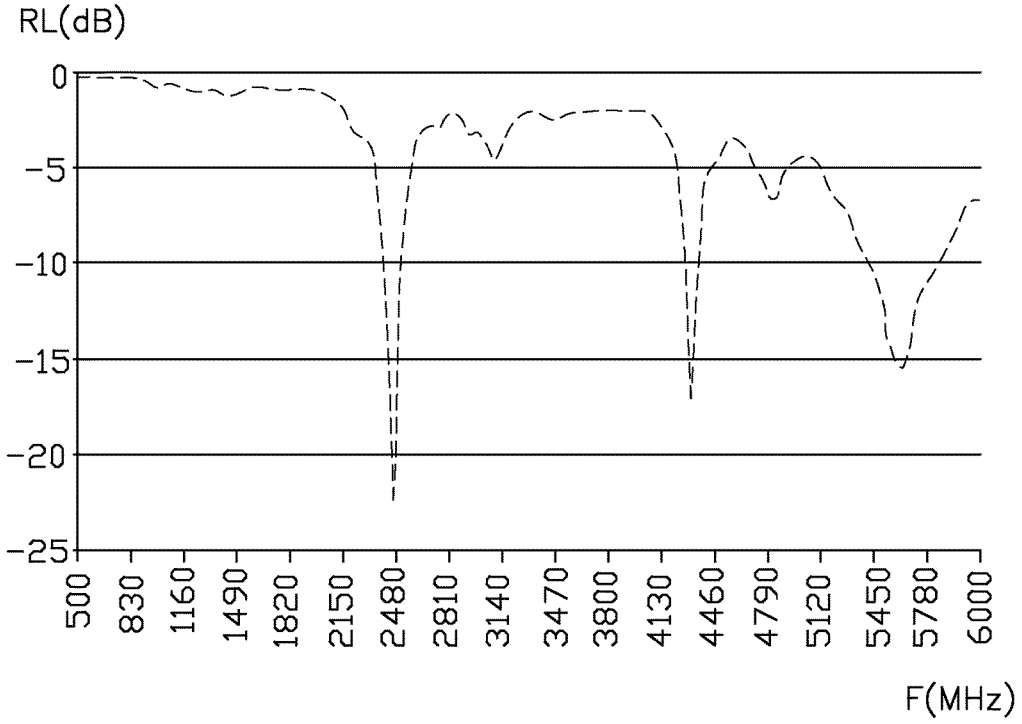
FIG. 5 is a return loss (RL) graph of a first antenna of the antenna assembly in FIG. 1.
Figure 6:
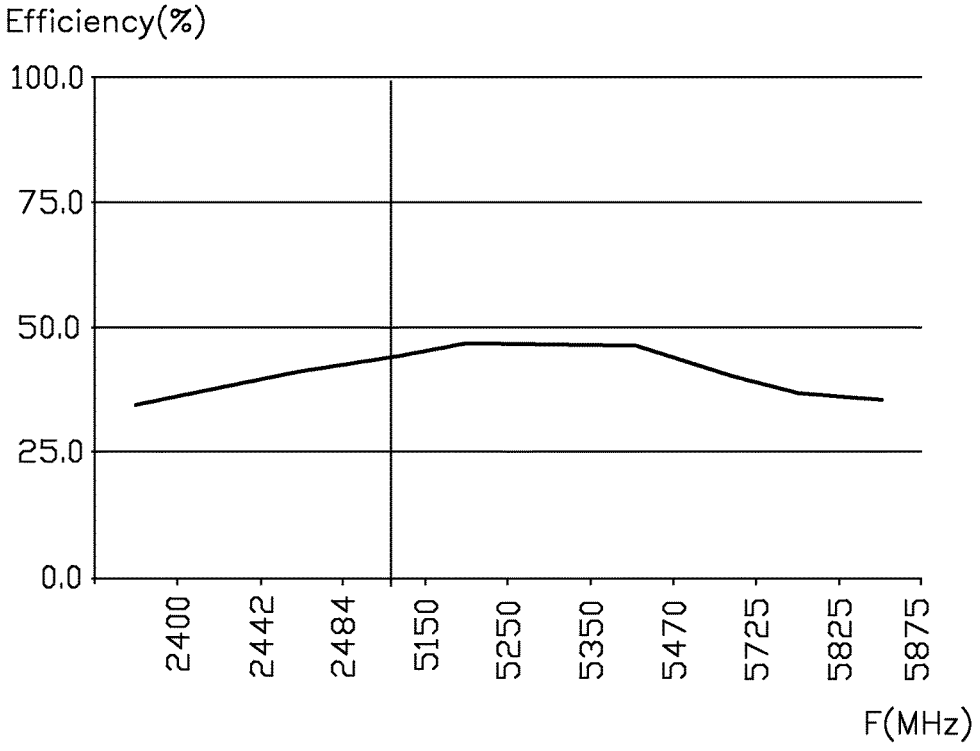
FIG. 6 is an antenna efficiency graph of the first antenna of the antenna assembly in FIG. 1.

Now referring to FIG. 2, when the current is input to the feed section 131, the current flows to the extension section 133, the connection section 135, and the coupling section 137, and then the current is grounded via the ground section 139 and the first side plate 112 for resonating a first frequency. That is, the feed section 131, the extension section 133, the connection section 135, the coupling section 137 and the ground section 139 can resonate the first frequency. In addition, the current is coupled from the feed section 131 to the coupling section 137, and thus the coupling section 137 can resonate a second frequency. In at least one embodiment, the first antenna 130 is configured to operate at the first frequency within a first frequency range between 2.4 GHz and 2.5 GHz and at the second frequency within a second frequency range between 5 GHz and 6 GHz. FIG. 5 illustrates a return loss (RL) of the first antenna 130, which is activated to receive and transmit wireless fidelity (WIFI) signals at the first frequency within the first frequency range between 2.4 GHz and 2.5 GHz and at the second frequency within the second frequency range between 5 GHz and 6 GHz. FIG. 6 illustrates an antenna efficiency of the first antenna 130. In view of the FIG. 6, the first antenna 130 has good performance when operating at about 2400 MHz and 5000 MHz.

Figure 7:
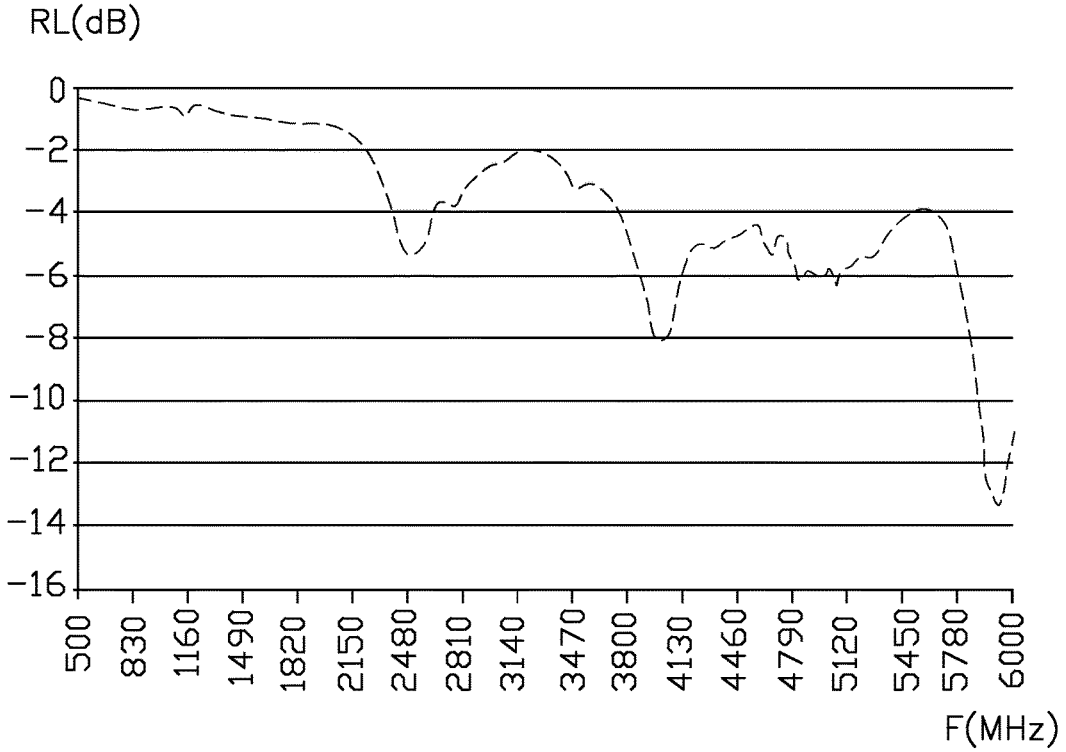
FIG. 7 is a return loss (RL) graph of a second antenna of the antenna assembly in FIG. 1.
Figure 8:
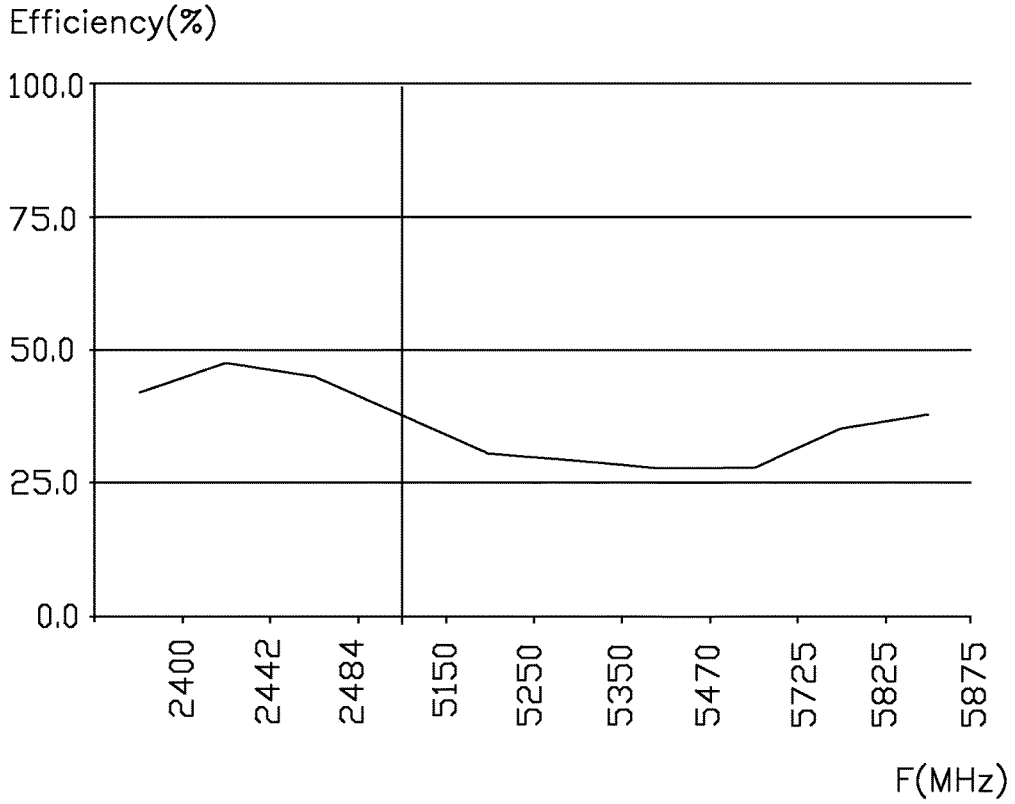
FIG. 8 is an antenna efficiency graph of the second antenna of the antenna assembly in FIG. 1.

Now referring to FIG. 3, when the current is input to the feed section 151, the current flows to the extension section 153, the connection section 155 and the ground section 157, and then the current is grounded via the ground section 157 and the second side plate 114 for resonating a third frequency. That is, the feed section 151, the extension section 153, the connection section 155 and the ground section 157 can resonate the third frequency. In addition, the current flows to the extension section 153, and thus the extension section 153 can resonate a fourth frequency. In at least one embodiment, the second antenna 150 is configured to operate at the third frequency within the first frequency range between 2.4 GHz and 2.5 GHz and at the fourth frequency within the second frequency range between 5 GHz and 6 GHz. FIG. 7 illustrates a return loss (RL) of the second antenna 150, which is activated to receive and transmit wireless fidelity (WIFI) signals at the third frequency within the first frequency range between 2.4 GHz and 2.5 GHz and at the fourth frequency within the second frequency range between 5 GHz and 6 GHz. FIG. 8 illustrates an antenna efficiency of the second antenna 150. In view of the FIG. 8, the second antenna 150 has good performance when operating at about 2400 MHz and 5000 MHz.

Figure 9:
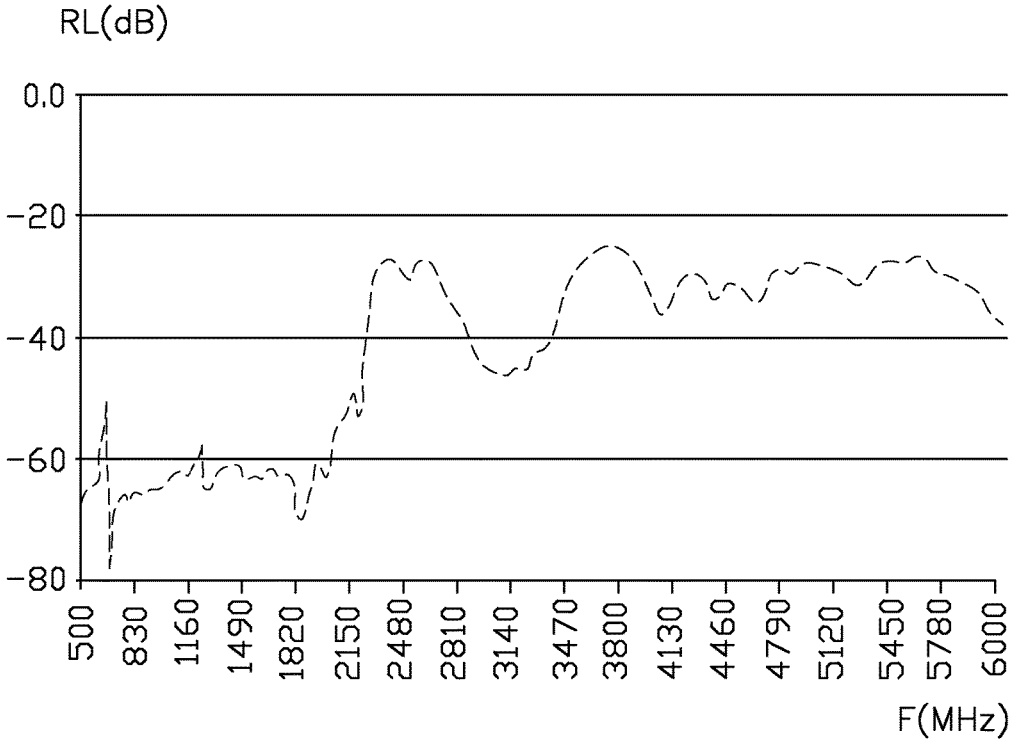
FIG. 9 is an antenna isolation graph of the first antenna and the second antenna of the antenna assembly in FIG. 1.

Moreover, FIG. 9 illustrates an antenna isolation of the antenna assembly 100. Since the first antenna 130 and the second antenna 150 are respectively secured on the first side plate 112 and the second side plate 114, and thus the first antenna 130 may not be influenced by the second antenna 150, and an envelope correlation coefficient (ECC) between the first antenna 130 and the second antenna 150 is significantly reduced. In at least one embodiment, the antenna isolation between the first antenna 130 and the second antenna 150 can be about −25 dB.

In summary, the metallic frame 110 defines the first opening 1122 and the second opening 1142 for receiving the first antenna 130 and the second antenna 150, respectively, which allows further size reductions of the wireless communication device 200 employing the antenna assembly 100. In addition, a radiating capability of the antenna assembly 100 of the wireless communication device 200 is effectively improved because the first antenna 130 and the second antenna 150 are spaced from each other.

The embodiments shown and described above are only examples. Many details are often found in the art such as the other features of the antenna assembly and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna assembly used in a wireless communication device, the antenna assembly comprising:

a metallic frame comprising a first side plate and a second side plate connected to the first side plate, wherein the first side plate defines a first opening and the second side plate defines a second opening;

a first antenna received in the first opening and secured on the first side plate; and a second antenna received in the second opening and secured on the second side plate;

wherein the first antenna is grounded by the first side plate, and the second antenna is grounded by the second side plate;

wherein the first antenna comprises a first feed section, a first extension section perpendicularly connected to the first feed section, a first connection section connected to the first extension section, a first coupling section connected to the first connection section, and a first ground section connected to the first extension section; and wherein the first coupling section and the first feed section define a gap therebetween;

wherein the second antenna comprises a second feed section, a second extension section connected to the second feed section, a second connection section connected to the second feed section, and a second ground section connected to the second connection section.

2. The antenna assembly as claimed in claim 1, wherein the first antenna is a dual-band loop antenna.

3. The antenna assembly as claimed in claim 1, wherein the first feed section is configured to receive current; wherein the first feed section, the first extension section, the first connection section, the first coupling section, and the first ground section are configured to resonate a first frequency; and wherein the first coupling section is configured to resonate a second frequency.

4. The antenna assembly as claimed in claim 3, wherein the first extension section comprises a first extension sheet and a second extension sheet, the first extension sheet is perpendicularly connected to the first feed section, the second extension sheet is perpendicularly connected to the first extension sheet and the second extension sheet is opposite to the first feed section.

5. The antenna assembly as claimed in claim 4, wherein the first connection section comprises a first connection sheet and a second connection sheet perpendicularly connected to the first connection sheet, the first connection sheet is connected between the second extension sheet and the first coupling section, the second connection sheet is parallel to the second extension sheet and the second connection sheet is perpendicularly connected to the first extension sheet, the first coupling section has a substantially rectangular shape and is spaced from the first feed section to allow the current to be coupled from the first feed section to the first coupling section.

6. The antenna assembly as claimed in claim 5, wherein the first ground section is connected to the second extension sheet and the first ground section is secured on the first side plate.

7. The antenna assembly as claimed in claim 1, wherein the second antenna is a dual-band loop antenna.

8. The antenna assembly as claimed in claim 1, wherein the second feed section is configured to receive current; wherein the second feed section, the second extension section, the second connection section, and the second ground section are configured to resonate a third frequency; and wherein the second extension section is configured to resonate a fourth frequency.

9. The antenna assembly as claimed in claim 8, wherein the second feed section comprises a first feed branch and a second feed branch perpendicularly connected to the first feed branch, the second extension section is connected to a junction of the first feed branch and the second feed branch, the second connection section is an L-shaped sheet, a first branch of the second connection section is perpendicularly connected to the second feed branch, and a second branch of the second connection section extends parallel to the second feed branch.

10. The antenna assembly as claimed in claim 9, wherein the second ground section comprises a main branch and an extension branch, the main branch is perpendicularly connected to the second branch of the second connection section and the main branch is configured to be secured on the second side plate, and the extension branch is perpendicularly connected to the main branch and the extension branch extends towards the first feed branch.

11. A wireless communication device, comprising:

a housing comprising a metallic frame; and an antenna assembly comprising:

a first antenna; and a second antenna;

wherein the metallic frame comprises a first side plate and a second side plate connected to the first side plate, the first side plate defines a first opening, and the second side plate defines a second opening;

wherein the first antenna is received in the first opening, secured on the first side plate and grounded by the first side plate; and wherein the second antenna is received in the second opening, secured on the second side plate and grounded by the second side plate;

wherein the first antenna comprises a first feed section, a first extension section perpendicularly connected to the first feed section, a first connection section connected to the first extension section, a first coupling section connected to the first connection section, and a first ground section connected to the first extension section; and wherein the first coupling section and the first feed section define a gap therebetween;

wherein the second antenna comprises a second feed section, a second extension section connected to the second feed section, a second connection section connected to the second feed section, and a second ground section connected to the second connection section.

12. The wireless communication device as claimed in claim 11, wherein the first antenna is a dual-band loop antenna; wherein the first feed section is configured to receive current; wherein the first feed section, the first extension section, the first connection section, the first coupling section, and the first ground section are configured to resonate a first frequency; and wherein the first coupling section is configured to resonate a second frequency.

13. The wireless communication device as claimed in claim 11, wherein the first extension section comprises a first extension sheet and a second extension sheet, the first extension sheet is perpendicularly connected to the first feed section, the second extension sheet is perpendicularly connected to the first extension sheet and is opposite to the first feed section, and wherein the first connection section comprises a first connection sheet and a second connection sheet perpendicularly connected to the first connection sheet, the first connection sheet is connected between the second extension sheet and the first coupling section, the second connection sheet is parallel to the second extension sheet and the second connection sheet is perpendicularly connected to the first extension sheet, the first coupling section has a substantially rectangular shape and is spaced from the first feed section to allow the current to be coupled from the first feed section to the first coupling section, and wherein the first ground section is connected to the second extension sheet and the first ground section is secured on the first side plate.

14. The wireless communication device as claimed in claim 11, wherein the second antenna is a dual-band loop antenna; wherein the second feed section is configured to receive current, and the second feed section, the second extension section, the second connection section and the second ground section are configured to resonate a third frequency; and wherein the second extension section is configured to resonate a fourth frequency.

15. The wireless communication device as claimed in claim 11, wherein the second feed section comprises a first feed branch and a second feed branch perpendicularly connected to the first feed branch, the second extension section is connected to a junction of the first feed branch and the second feed branch, the second connection section is an L-shaped sheet, a first branch of the second connection section is perpendicularly connected to the second feed branch, and a second branch of the second connection section extends parallel to the second feed branch; and wherein the second ground section comprises a main branch and an extension branch, the main branch is perpendicularly connected to the second branch of the second connection section and the main branch is configured to be secured on the second side plate, and the extension branch is perpendicularly connected to the main branch and the extension branch extends towards the first feed branch.

16. The wireless communication device as claimed in claim 11, wherein the first antenna and the second antenna constitute a multiple input multiple output (MIMO) antenna system for receiving or transmitting wireless signals simultaneously.

17. The wireless communication device as claimed in claim 16, further comprising a MIMO signal detecting module and a central processing unit (CPU) electronically coupled to the MIMO signal detecting module; wherein the MIMO signal detecting module is electronically coupled to the first antenna and the second antenna for detecting the signal intensity of a first wireless signal received or transmitted by the first antenna and the signal intensity of a second wireless signal received or transmitted by the second antenna; wherein the MIMO signal detecting module is configured to compare the signal intensity of the first wireless signal with the signal intensity of the second wireless signal so as to generate a comparison result; and wherein the CPU is configured to determine one of the first antenna and the second antenna to serve as a primary antenna and another to serve as a secondary antenna according to the comparison result.

18. The wireless communication device as claimed in claim 17, wherein if the comparison result indicates that the detected signal intensity of the first wireless signal is greater than or equal to the detected signal intensity of the second wireless signal, the CPU determines the first antenna to serve as the primary antenna and the second antenna to serve as the secondary antenna; if the comparison result indicates that the detected signal intensity of the first wireless signal is less than the detected signal intensity of the second wireless signal, the CPU determines the first antenna to serve as the secondary antenna and the second antenna to serve as the primary antenna.

* * * * *